United States Patent [19]

Koike

[11] Patent Number: 4,855,733

[45] Date of Patent: Aug. 8, 1989

[54] INCLINATION DETECTOR ADJUSTING DEVICE FOR VESSEL PROPULSION UNIT

[75] Inventor: Takashi Koike, Hamamatsu, Japan

[73] Assignee: Sanshin Kogyo Kabushiki Kaisha, Hamamatsu, Japan

[21] Appl. No.: 216,089

[22] Filed: Jul. 6, 1988

[30] Foreign Application Priority Data

Jul. 9, 1987 [JP] Japan ..... 62-171924

[51] Int. Cl.[4] ..... G08B 1/08

[52] U.S. Cl. ..... 340/870.19; 33/1 N; 440/2

[58] Field of Search ..... 440/2; 340/870.04, 870.19, 340/870.21; 73/1 E, 118.1, 862.22, 862.52; 33/1 N; 364/431.04

[56] References Cited

U.S. PATENT DOCUMENTS 4,652,878 3/1987 Borgersen ..... 440/2 X 4,722,705 2/1988 Rawlings ..... 440/2

*Primary Examiner*—Jerry W. Myracle

*Attorney, Agent, or Firm*—Ernest A. Beutler

[57] ABSTRACT

A position sensing device and method for setting it particularly adapted for use in determining the trim position in a marine outboard drive. The position sensing device includes a sensor that is adjustably mounted and which has a control circuit that incorporates a device for sensing if the initial position of the sensing device is within a predetermined range and if so amplifying the output signal from the device for fine adjustment by use of an external meter.

11 Claims, 4 Drawing Sheets

INCLINATION DETECTOR ADJUSTING DEVICE FOR VESSEL PROPULSION UNIT

BACKGROUND OF THE INVENTION

This invention relates to an inclination detector adjusting device for vessel propulsion units and more particularly to an improved position sensing device for marine outboard drives and method for adjusting it.

In a variety of marine applications, there is provided a position sensing device for sensing the trim angle of the outboard drive. Such trim angle sensors may be used either in conjunction with outboard motors or with the outboard drive section of an inboard/outboard drive. The trim position sensor is used for a wide variety of purposes and may provide merely an indication of trim angle or, in some instances, may provide an input signal to a more complicated control system. For example, this type of device can be used in conjunction with automatic trim adjustors, trim adjustors that maintain the trim in the desired condition to obtain a desired watercraft running condition or a wide variety of other applications.

The trim position sensor normally is comprised of a housing that is adjustably affixed to one component of the outboard drive and a moveable element that is movably connected to the housing and which is fixed for movement with another component of the outboard drive. As a result of the relative movement between the outboard drive components, the elements of the trim position sensor change in relative position and an output signal is provided that varies in response to the angular position.

Although the aforenoted type of device is particularly advantageous, it is necessary to accurately mount the trim position sensor on the supporting outboard drive component in an accurate condition. This is necessary to permit the 0° adjustment of the device so that the output reading will be accurate in response to the actual angular position of the components.

FIG. 1 of the drawings illustrates a typical trim position sensor and its method of mounting and FIG. 2 indicates the way in which the initial position of the sensor is set. These figures depict and illustrate the problems attendant with conventional prior art constructions.

Referring first to FIG. 1, a trim position sensor is identified generally by the reference numeral 11 and includes an outer housing 12 that has a pair of mounting flanges 13. These mounting flanges 13 are provided with elongated or arcuate slots 14 that pass respective threaded fasteners 15. The fasteners 15 may be loosened so as to permit adjustment of the housing 12 and then are locked in place.

The sensor 11 further includes a moveable element 16 that is connected to another component of the outboard drive for direct movement with that component. The relative positions of the element 16 and housing 12 will provide a signal indicative of the position of the outboard drive component.

Typically, the indicating device 11 may be a potentiometer and FIG. 2 shows schematically how the potentiometer is utilized in conjunction with the circuit. The potentiometer includes a winding 17 that is fixed within the housing 12 and which cooperates with a wiper 18 that is fixed for movement with the element 16. A constant voltage supply is applied to the potentiometer winding 17 from a constant voltage source through terminals IN and E. This input voltage is indicated by the signal "Vie". The voltage across one of the terminals and the wiper terminal (OUT) indicated by the signal "Voe" provides a voltage signal indicative of the angular position.

In order to initially set the position of the potentiometer or position sensor 11, the device is loosely fastened in place and a voltage supply is applied to the device. The device is then rotated with the wiper in a preset position until a predetermined potential is determined at the output Voe. However, the exact setting of the device is sometimes impossible in spite of accurate measurement of the resistance between the terminals OUT and E because of large variations in the total resistance between the terminals IN and E of the sensor. In some vessels, it is also impossible to move the sensor in small increments while reading a meter indication for setting. Furthermore, a voltage stabilizer and high precision digital circuit tester are essential for accurate setting.

It is, therefore, a principal object of this invention to provide an improved inclination sensor or trim position sensor for a marine outboard drive that is easier to adjust and does not require external components.

It is a further object of this invention to provide an improved position sensor and method for sensing a position sensor that can be utilized with marine outboard drives.

SUMMARY OF THE INVENTION

This invention is adapted to be embodied in a position sensing device for providing an indication of the position of a component of an outboard drive. The position sensing device has a first portion that is adapted to be adjustably connected to one component of the outboard drive and a second portion that is adapted to be affixed to another component of the outboard drive. The sensor portions are relatively moveable for providing a variable output signal indicative of the relative positions of the outboard drive components. A power supply is incorporated for applying a source of power to the position sensing device. In accordance with one feature of the invention, the device includes switching means for outputting a first low source of power to the sensing device and if the first portion is set within a predetermined range of positions relative to the one outboard drive component a second greater signal is output so as to permit fine adjustment.

Another feature of the invention is adapted to be embodied in a method for setting a position sensor of the type described in the preceding paragraph. In accordance with this method, a first low power output from to the position sensor to determine if it is within a first preset range relative to the supporting outboard drive component. If it is, a substantially greater power is output so as to permit fine adjustment of the device.

DETAILED DESCRIPTION OF THE PREFERRED EMBODIMENT OF THE INVENTION

Figure 4:
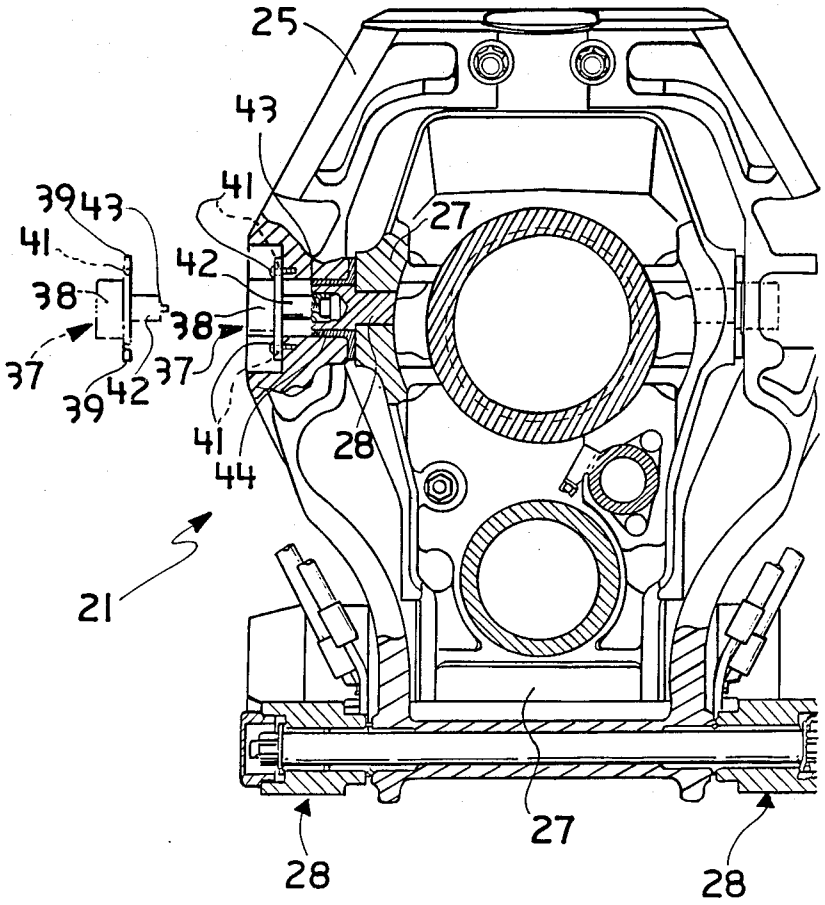
FIG. 4 is an enlarged cross-sectional view taken along the line 4—4 of FIG. 3.
Figure 3:
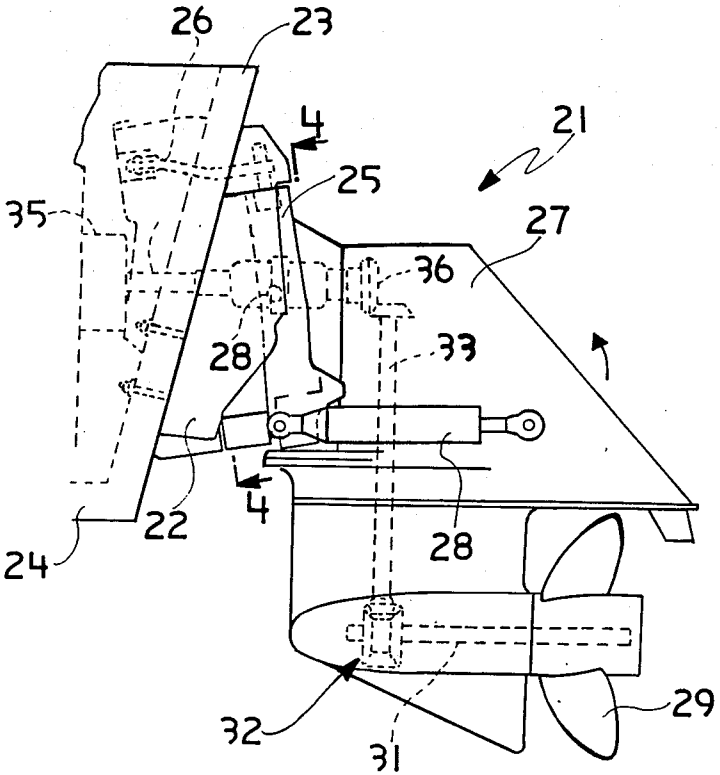
FIG. 3 is a side elevational view of a marine outboard drive constructed in accordance with an embodiment of the invention.

Referring in detail first to FIGS. 3 and 4, a marine outboard drive constructed in accordance with an embodiment of the invention is identified generally by the reference numeral 21. The outboard drive 21 is, in the illustrated embodiment, of the inboard/outboard type and includes a gimbal housing 22 that is connected to a transom 23 of a watercraft 24 in a known manner. A gimbal ring 25 is pivotably connected to the gimbal housing 21 for steering movement about a generally vertically extending steering axis. The gimbal ring 25 is steered by means including a steering arm 26.

A propulsion unit 27 is pivotally connected to the gimbal ring 25 by means of a pair of pivot pin assemblies 28 that are disposed on diametrically opposite sides of the gimbal ring 25. This pivotal movement permits trim and tilt adjustment of the propulsion unit 27.

A pair of hydraulic cylinder assemblies 28 are interconnected between the gimbal ring 25 and propulsion unit 27 so as to permit powered trim adjustment and to permit tilting up of the propulsion unit 27 relative to the transom 23. Any known type of control arrangement may be utilized for this purpose.

The propulsion unit 27 includes a propeller 29 that is affixed to a propeller shaft 31 that is journaled within the propulsion unit 27. A forward, neutral, reverse transmission 32 drives the propeller shaft 31 in selected forward or reverse directions from a drive shaft 33 that is journaled for rotation about a generally vertically extending axis within the propulsion unit 27. A driving shaft 34 is driven by an internal combustion engine 35 contained within the watercraft hull 24 and drives the drive shaft 33 through a bevel gear train 36.

The construction as thus far described may be of any conventional type and, for that reason, details of its construction are not believed to be necessary to understand the construction and operation of the invention.

Figure 1:
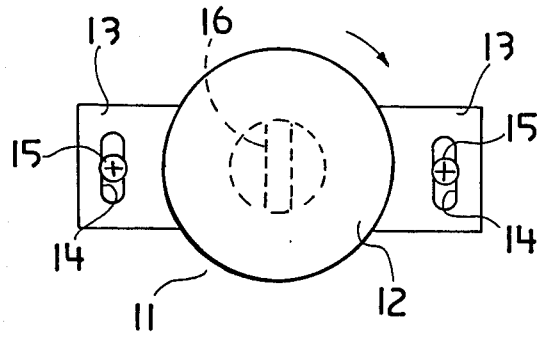
FIGURE 1 PRIOR ART
FIG. 1 is a side elevational view of a conventional position sensing device showing the problems attendant with its adjustment.
Figure 2:
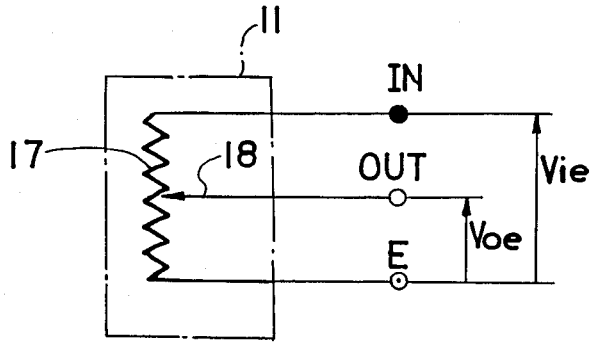
FIGURE 2 PRIOR ART
FIG. 2 is a schematic electrical diagram of a conventional position sensing device.

In accordance with the invention, a positioned detector or trim condition sensor, indicated generally by the reference numeral 37 is detachably connected to the gimbal ring 25 and cooperates with one of the pivot pins 28 for providing an indication of the trim and tilt angle of the propulsion unit 27 relative to the gimbal ring 25 and, accordingly, the transom 23. Like the device shown in FIG. 1, the position sensor 37 includes an outer housing assembly 38 having mounting flanges 39 in which slots 41 are formed. The housing 38 has a pilot portion 42 that journals a wiper shaft 43.

FIG. 4 shows an exploded view with the position sensing device 37 removed in phantom lines. The position sensing device 37 is assembled by moving it into an axial recess formed in the gimbal ring 25 until a flat on the wiper shaft 43 engages an appropriate slot formed in the pivot pin 28. This provides a direct rotatable coupling between the pivot pin 28 and the wiper shaft 43. The pivot pin 28 is, in turn non-rotatably affixed to the propulsion unit 27 so that its rotation relative to the gimbal ring 25 will also accomplish rotation of the wiper shaft 43.

As with the prior art devices, the housing 38 is held initially loosely in position by threaded fasteners 44 that are threaded into the gimbal ring 25.

Figure 5:
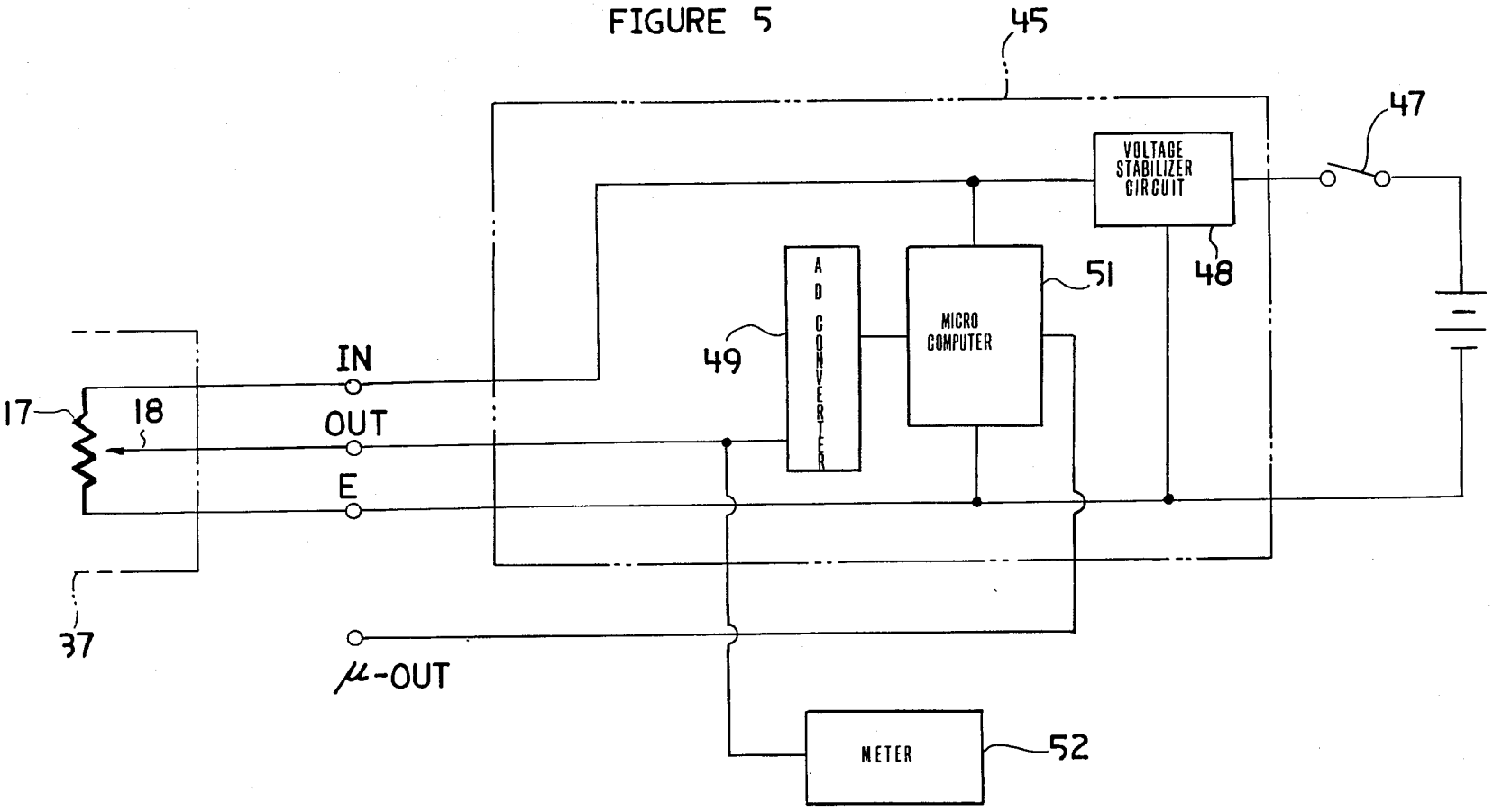
FIG. 5 is a schemtic view showing the electrical circuitry of the position sensing device and its components.

Referring now to FIG. 5, the control circuit and indicator circuit associated with the sensing device 37 is shown schematically. This circuit includes an automatically controlled arrangement for permitting initial adjustment of the sensing device 37 and specifically the housing 38 relative to the gimbal ring 25. As with the prior art arrangements, the sensor 37 includes a variable resistance winding 17 and wiper 18. The variable resistor 17 is contained within the housing 38 and the wiper 18 is affixed to the wiper shaft 43. It should be noted that, although the invention is described with a potentiometer type of device, the invention may be utilized in conjunction with other forms of position sensors.

The sensor 37 is in circuit with a control unit, indicated generally by the reference numeral 45 which control unit is further connected to a power supply such as a battery 46 through a main control switch 47. When the main control switch 47 is closed, a voltage stabilizer circuit 48 of the control device 45 applies a steady state EMF across the terminals IN and E of the potentiometer winding 17. Unlike the prior art devices, however, the control circuit 45 also includes an analog to digital convertor 49 that receives the output signal from the wiper output terminal OUT. This signal is transmitted to a microcomputer 51 or comparator circuit for the purpose of adjustment of the position of the sensing device 37 and specifically the housing 38. This output signal is transmitted through a indicator terminal $\mu$-OUT for attachment to an external meter (not shown) for zero adjustment, as will be described.

Figure 6:
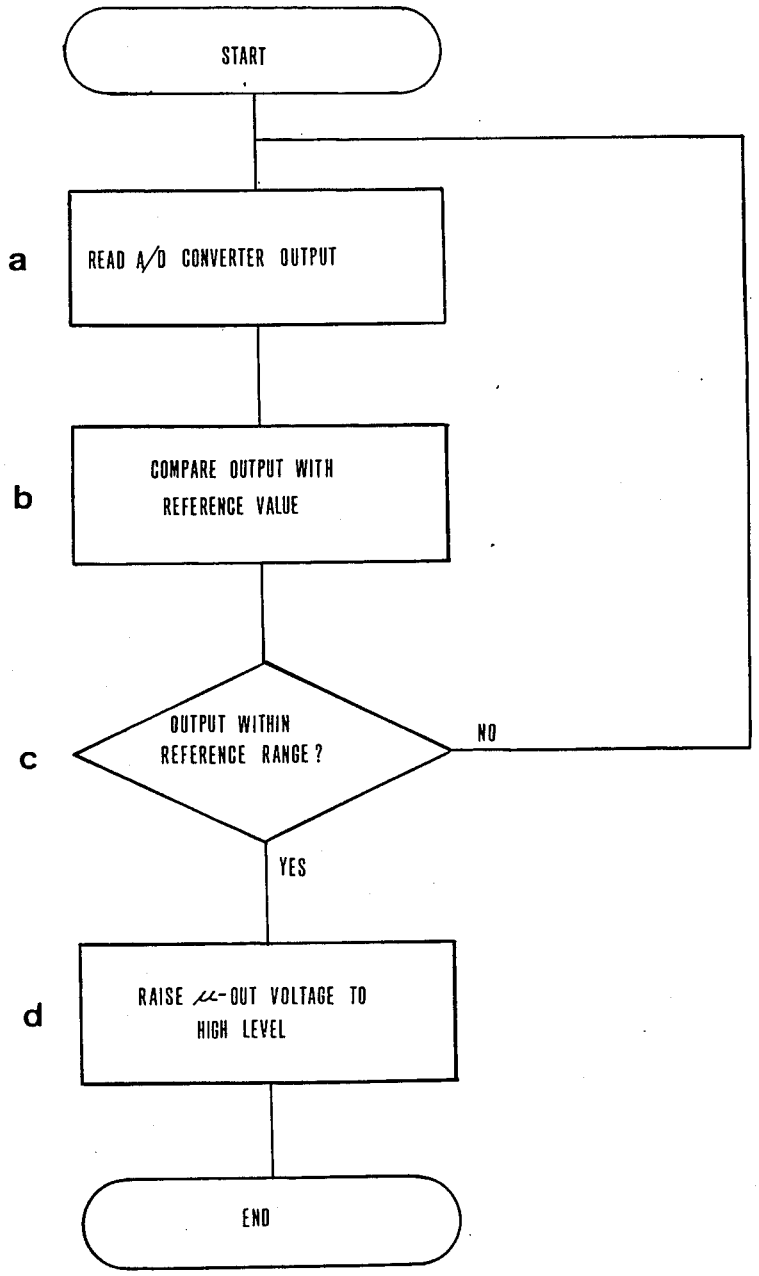
FIG. 6 is a block diagram showing the logic for the adjusting circuit.

The normal output from the wiper output terminal OUT is transmitted to a meter 52 which provides an analog signal that is indicative of the trim position of the propulsion unit 27, once the system has zeroed in the manner now to be described by particular reference to FIG. 6.

FIG. 6 shows the logic of the microcomputer 51 in providing adjustment of the sensing device 37 relative to the gimbal ring 27. Basically, the device 37 is initially installed and the microcomputer 51 then determines if the initial installation is within a predetermined angular range of the desired angle to be set. If it is, the microcomputer then amplifies the output signal so that a very fine adjustment may be made in the final positioning. If, however, the device is not within the preset range, then the operator must reset the unit 37 until it is within that range. Once this has been done, then the microcomputer amplifies the output and the fine adjustment is permitted.

Referring now to FIG. 6, the program by which the microcomputer operates is illustrated. After the system is in the "start" mode, it proceeds to the step "a" wherein the reading of the analog to digital converter is read. This is to determine if the initial set position for the sensing device 37 is within the preset range. This comparison is made at the step "b" to determine if the reading is within this range. Then at the step "c" the output signal is indicated and if it is not within the preset range, the device returns back to before the step a. The operator should then remove the device 37 and reset it to a new initial position wherein the steps a, b and c are again repeated.

Once the microcomputer 51 determines that the device 37 initially is set within the preset range, it moves to the step "d" wherein the output signal $\mu$-OUT is raised to a high level so as to amplify the output of the sensing device 37. A very fine adjustment may then be made so as to obtain the desired meter reading and the device 37 is locked in position by tightening the screws 44.

It should be readily apparent that the aforenoted system is very effective in permitting adjustment of the device without complicated external circuitry and without necessitating analog to digital converters externally of the system.

The foregoing description is that of a preferred embodiment of the invention and various changes and modifications may be made without departing from the spirit and scope of the invention as defined by the appended claims.

I claim:

1. A position sensing device for providing an indication of the position of a member of an outboard drive comprising a position sensing device having a first portion adapted to be adjustably connected to one component of said outboard drive and a second portion adapted to be affixed to another component of said outboard drive, said sensor portions being relatively moveable for providing a variable output signal indicative of the relative positions of said outboard drive components, and a power supply for applying a source of power to said position sensing device, the improvement comprising means for determining if the position sensing device is in a first position within a predetermined range and for amplifying the output of said position sensing device if within said preset range for providing fine adjustment thereof.

2. A position sensing device for providing an indication of the position of a member of an outboard drive as set forth in claim 1 wherein the means for determining the position of the position sensing device includes an analog to digital computer.

3. A position sensing device for providing an indication of the position of a member of an outboard drive as set forth in claim 2 wherein the analog to digital converter outputs a digital signal to a comparator to determine if the position is within the predetermined range.

4. A position sensing device for providing an indication of the position of a member of an outboard drive as set forth in claim 3 wherein the comparator controls an amplifier for providing the amplified output signal.

5. A position sensing device for providing an indication of the position of a member of an outboard drive as set forth in claim 4 wherein the amplifier and comparator form a portion of a microcomputer.

6. A position sensing device for providing an indication of the position of a member of an outboard drive as set forth in claim 1 wherein the output signal of the position sensing device is supplied to an external meter for position setting.

7. A position sensing device for providing an indication of the position of a member of an outboard drive as set forth in claim 6 wherein the means for determining the position of the position sensing device includes an analog to digital computer.

8. A position sensing device for providing an indication of the position of a member of an outboard drive as set forth in claim 7 wherein the analog to digital converter outputs a digital signal to a comparator to determine if the position is within the predetermined range.

9. A position sensing device for providing an indication of the position of a member of an outboard drive as set forth in claim 8 wherein the comparator controls an amplifier for providing the amplified output signal.

10. A position sensing device for providing an indication of the position of a member of an outboard drive as set forth in claim 9 wherein the amplifier and comparator form a portion of a microcomputer.

11. The method of setting a position sensing device for providing an indication of the position of a member of an outboard drive comprising a position sensing device having a first portion adapted to be adjustably connected to one component of said outboard drive and a second portion adapted to be affixed to another component of said outboard drive, said sensor portions being relatively moveable for providing a variable output signal indicative of the relative positions of said outboard drive components, and a power supply for applying a source of power to said position sensing device, comprising the steps of determining if the position sensing device is in a first position within a predetermined range and amplifying the output of said position sensing device if within said preset range for providing fine adjustment thereof.

* * * * *